United States Patent [19]

Morishita et al.

[11] Patent Number: 4,781,550

[45] Date of Patent: Nov. 1, 1988

[54] SCROLL COMPRESSOR WITH DRIVING AND DRIVEN SCROLLS

[75] Inventors: Etsuo Morishita; Masayuki Kakuda, both of Amagasaki; Masahiro Sugihara, Wakayama; Tsutomu Inaba, Wakayama; Toshiyuki Nakamura, Wakayama; Tadashi Kimura, Wakayama, all of Japan

[73] Assignee: Mitsubishi Denki Kabushiki Kaisha, Tokyo, Japan

[21] Appl. No.: 15,390

[22] Filed: Feb. 17, 1987

[30] Foreign Application Priority Data

Feb. 17, 1986 [JP] Japan ..... 61-32243
Mar. 7, 1986 [JP] Japan ..... 61-50815

[51] Int. Cl.[4] ..... F04C 18/04; F04C 29/02

[52] U.S. Cl. ..... 418/55; 418/56; 418/188

[58] Field of Search ..... 418/55, 59, 152, 178, 418/179, 188, 56

[56] References Cited

U.S. PATENT DOCUMENTS 3,600,114 8/1971 Dvorak et al. ..... 418/55
3,884,599 5/1975 Young et al. ..... 418/55
3,989,422 11/1976 Guttinger ..... 418/55
4,549,861 10/1985 Blain ..... 418/55

FOREIGN PATENT DOCUMENTS 1935621 1/1970 Fed. Rep. of Germany .
2160582 6/1973 Fed. Rep. of Germany .
2639174 5/1977 Fed. Rep. of Germany .

*Primary Examiner*—John J. Vrablik
*Attorney, Agent, or Firm*—Oblon, Fisher, Spivak, McClelland & Maier

[57] ABSTRACT

In a scroll type compressor, the shaft of a driven scroll is rotatably supported in a sealing container so that the axis of rotation of the driven scroll shaft is deviated from the axis of rotation of a driving scroll; the wrap plates of the driving and driven scrolls are mutually combined with each other so that the parts of the side surface of the wrap plates come in contact with each other to form a compression chamber; and the driven scroll is directly driven by the driving scroll in synchronism therewith, whereby the function of compression of a fluid is obtainable during the movement of the compression chamber toward the centers of the driving and driven scrolls.

5 Claims, 4 Drawing Sheets

SCROLL COMPRESSOR WITH DRIVING AND DRIVEN SCROLLS

BACKGROUND OF THE INVENTION

1. Field of the Invention

The present invention relates to a total system rotation type scroll compressor having a driving scroll and driven scroll.

2. Discussion of Background

The principle of the scroll compressor has been known. The scroll compressor is a kind of a positive displacement type compressor in which a pair of scrolls are combined with each other to effect compression of a fluid.

In the ordinary scroll compressor, one of the scrolls is made stationary and the other is subject to an orbital movement with respect to the stationary scroll to effect the compression.

The principle of the total system rotation type scroll compressor in which both scrolls are respectively rotated around their own axial center, is also well known.

FIG. 6 shows the principle of the total system rotation type scroll compressor. A driving scroll 1 is caused to rotate around its own axial center $O_1$ by a driving source such as a motor, an engine, a turbine and so on. A driven scroll 2 is also caused to rotate around its axial center $O_2$ in synchronism with the rotation of the driving scroll 1. A compression chamber 3, which is formed by combining the driving and driven scrolls 1, 2, moves toward the rotation centers as the both scrolls rotate while the volume of the chamber 3 is gradually reduced. The pressure of a gas confined in the compression chamber 3 increases and a highly pressurized gas is discharged through a dischage port 2*c*.

FIG. 6*a* shows a state of the combined driving and driven scrolls 1, 2 at its moving phase of 0°, in which the gas is sucked in the compression chamber 3. As the scrolls rotate, they assume the moving phase of 90°, 180°, 270° and 360° C. (0°) succesively, whereby the compression chamber 3 gradually shifts toward their revolution centers with the result of reduction in the volume of the gas. The two scrolls 1, 2 provide sealing portions by mutual contact of the side surfaces of the wrap plates 1*a*, 2*a* of the scrolls 1, 2. As shown in FIG. 6, the sealing portions s are in alignment with each other in the radial direction of the driving and driven scrolls 1, 2; namely, they always take a constant positional relation in a static state of the scrolls.

U.S. Pat. No. 3,884,599 schematically shows the conventional total system rotation type scroll compressor. In the construction disclosed in the U.S. patent, an Oldham coupling is used to maintain a given phase between a driving scroll and a driven scroll and to transmit a torque.

The conventional scroll compressor has disadvantages as follows. It is provided with a sliding part in which structural elements undergo a reciprocating movement on the sliding surface of the sliding part. Accordingly, mass in the construction is large and therefore, it is not suitable to perform a high speed revolution.

Further, since the Oldham's coupling is arranged around the both scrolls, the size of the scroll compressor is large.

SUMMARY OF THE INVENTION

It is an object of the present invention to provide a scroll compressor of a reduced number of elements, a simple structure and a low vibration, hence it is suitable for a high speed revolution with a high performance.

The foregoing and the other objects of the present invention have been attained by providing a scroll compressor which comprises a sealing container, a first fixed part placed inside the container, a driving scroll comprising a circular plate portion, a wrap plate formed on a surface of the circular plate portion and a shaft extending from the other surface of the circular plate portion, the shaft being rotatably supported by the first fixed part, a second fixed part placed inside the container so as to oppose the first fixed part with a certain space, a driven scroll comprising a circular plate portion, a wrap plate formed on a surface of the circular plate portion and a shaft extending from the other surface of the circular plate portion in the opposite direction to the shaft of the driving scroll, wherein the shaft of the driven scroll is rotatably supported by the second fixed part so that the axis of rotation of the driven scroll shaft is deviated from the axis of rotation of the driving scroll; the wrap plates of the driving and driven scrolls are mutually combined with each other so that parts of the side surfaces of the wrap plates come in contact to form a compression chamber; and the driven scroll is directly driven by the driving scroll in synchronism therewith, whereby the function of compression of a fluid is obtainable during the movement of the compression chamber toward the centers of the driving and driven scrolls.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
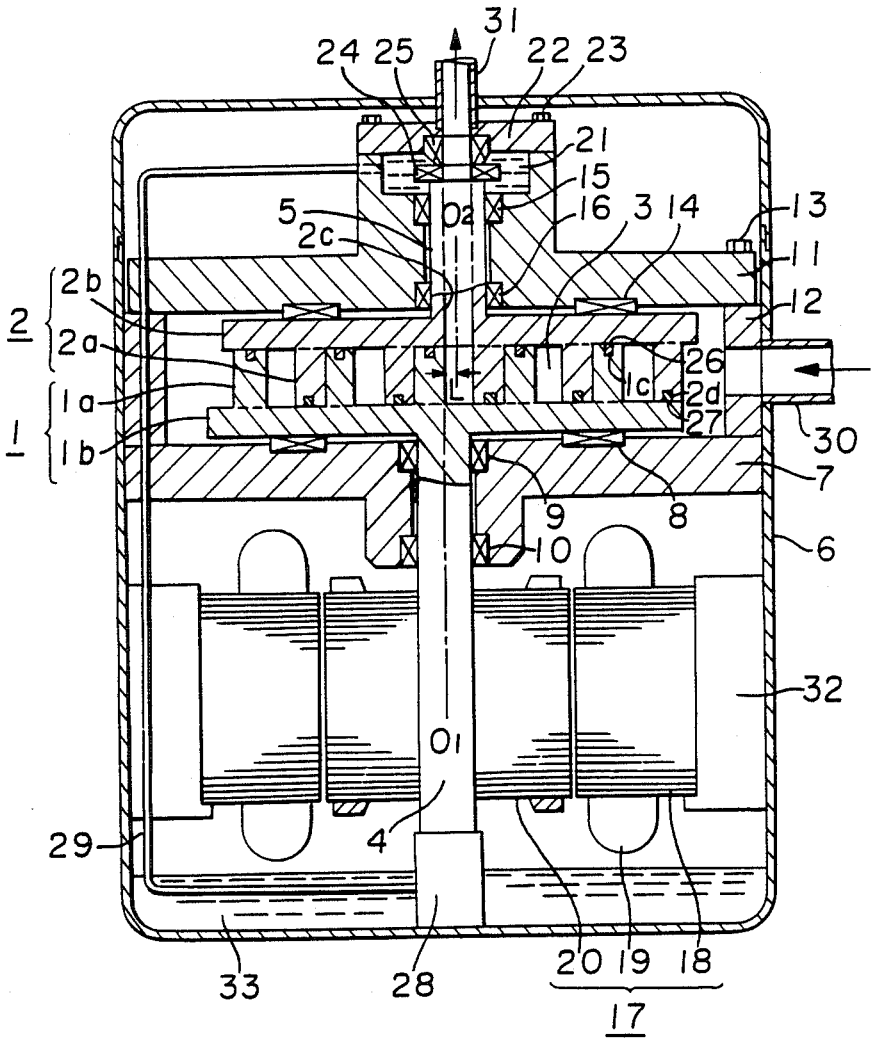
FIG. 1 is a longitudinal cross-sectional view of an embodiment of the scroll compressor according to the present invention.
Figure 2:
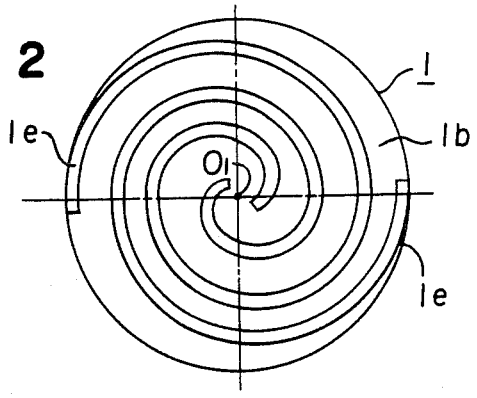
FIG. 2 is a plane view of a second embodiment of a driving scroll used for the present invention.

An embodiment of the scroll compressor according to the present invention will be described with reference to FIG. 1.

A reference numeral 6 designates a sealing container. Inside the sealing container 6, an upper bearing supporter 11 (a first fixed part) is secured to the inner wall of the container 6 by means of bolts 13 and a carrier 12. The upper bearing supporter 11 supports a driven scroll 2 through thrust bearings 14 so as to determine the position of the driven scroll 2 in the vertical direction and supports the shaft 5 of the driven scroll 2 through radial bearings 15, 16 so as to determine the position in the radial direction.

A lower bearing supporter 7 (a second fixed part) is also secured to the inner wall of the sealing container 6 so as to oppose the upper bearing supporter 11 with a certain space. The lower bearing supporter 7 supports the bottom of the driving scroll 1 from the lower part through thrust bearings 8. It also supports the shaft 4 of the driving scroll 1 through radial bearings 9, 10 so as to determine the position of the driving shaft 4 in the radial direction.

The driving scroll comprises a circular plate portion 1*b*, a wrap plate 1*a* formed on one surface of the circular plate portion 1*b* and the driving shaft 4 extending from the other surface of the circular plate portion 1*b*.

The driven scroll 2 comprises a circular plate portion 2*b*, a wrap plate 2*a* formed on one side surface of the plate portion 2*b* and the driven shaft 5 formed on the other surface of the plate portion 2*b*. The wrap plates 1*a*, 2*a* of the driving and driven scrolls 1, 2 are mutually combined with each other in such a manner that a compression chamber 3 is formed by the opposing surfaces of the driving and driven scrolls 1, 2 and the wrap plates 1*a*, 2*a* of the scrolls. A discharging conduit 2*c* is formed in the driven shaft 5 extending along the axial line to communicate the compression chamber 3 with a discharge port.

The driving and driven scrolls 1, 2 are placed at such position of $L=p/2-t$, where L is the distance between the axial center $O_1$ of the driving scroll 1 and the axial center $O_2$ of the driven scroll, p is a pitch of the spiral the wrap plate and t is the thickness of the wrap plate.

An electric motor as a driving source 17 comprises a stator iron core 18 in which stator coils 19 are mounted, the iron core 18 being supported by the sealing container 6 through a supporting member 32, and a rotor 20 firmly connected to the driving shaft 4.

An oil reservoir 21 is formed in the upper part of the upper bearing supporter 11. An end plate 22 is attached to the top of the upper bearing supporter 11 to cover the oil reservoir 21. A rotary mechanical seal 24 is mounted on the shaft 5, and a fixed mechanical seal 25 is mounted on the end plate 22 so that it is in contact with the mechanical seal 24 to prevent the leakage of a compressed gas. The seals 24 and 25 are immersed in the oil bath within the oil reservoir 21. A first tip seal 26 is fitted in a spiral groove 1*c* which is formed in the top end surface of the wrap plate 1*a*. A second tip seal 27 is fitted in a spiral groove 2*d* formed in the top end surface of the wrap plate 2*a*. An oil pump 28 is placed on the bottom of the sealing container 6 and is driven by the driving shaft 4 so that a lubricating oil is supplied to the oil reservoir 21 through an oil feeding pipe 29. An intake tube 30 is connected to the sealing container 6 to introduce a gas into the scrolls 1, 2. A reference numeral 31 designates a discharge tube connected to the end plate 32 to introduce the gas compressed in the scrolls to the outside of the container 6 through the discharging conduit 2*c*, the discharge tube 31 and end plate 22 together defining stationary discharge means and a numeral 33 designates the lubricating oil stored in the bottom part of the sealing container 6. The rotary and fixed seats 24 and 25 together define seal means for sealing the joint between shaft 5 and the stationary discharge means.

The operation of the scroll compressor having the construction as above-mentioned will be described.

On actuating the motor 17, the driving scroll 1 is rotated around its own axial center $O_1$. In FIG. 6, particularly at point A among the sealing portions S provided by the mutual contact of the scrolls 1, 2, a portion of the outer circumferential surface of the wrap plate 2*a* of the driven scroll 2 is in contact with a portion of the inner circumferential surface of the wrap plate 1*a* of the driving scroll 1. With respect to the point A, the inner circumferential part of the wrap plate 1*a* is shifted so as to reduce the distance between the axial center $O_1$ and the inner circumferential part at the point A of the wrap plate 1*a* when viewed from the axial center $O_1$. Accordingly, the portion naturally comes in contact with the outer circumferential part of the wrap plate 2*a*, whereby the driven scroll 2 is moved in accordance with the rotation of the driving scroll 1.

Under the condition that the driven scroll 2 follows the rotation of the driving scroll 1, if the revolution of the driven scroll 2 is higher than that of the driving scroll 1, a gap is produced at the point A (FIG. 6*b*) and any driving force is not transmitted. However, under the condition that the driven scroll 2 follows the driving scroll, the radius extending from the axial center $O_2$ of the driven scroll 2 to the inner circumferential surface of the wrap plate 2*a* at the point B gradually reduces as the scroll rotates, while the radius extending from the axial center $O_1$ of the driving scroll 1 to the outer circumferential surface of the wrap plate 1*a* at the point B increases. Accordingly, the wrap plates 1*a*, 2*a* come to mutual contact, whereby the revolution of the driven scroll 2 at a higher speed than the revolution of the driving scroll 1 is automatically controlled. Thus, by arranging the driving and driven scrolls 1, 2 in such a manner that the inner and outer circumferential parts of the wrap plates 1*a*, 2*a* come in contact with each other at the points A or B, i.e. at positions diametrically aligned, a synchronous rotation of the scrolls 1, 2 is established without using an Oldham coupling. The present invention embodies the technical idea as above-mentioned.

Figure 6A:
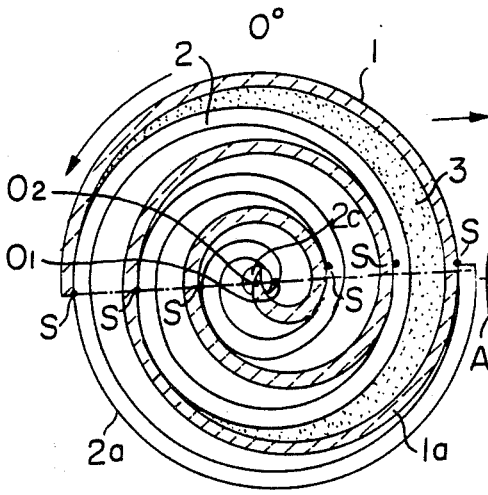
FIGS. 6*a* to 6*d* are diagrams showing the principle of the operation of a typical total system rotation type scroll compressor.
Figure 6B:
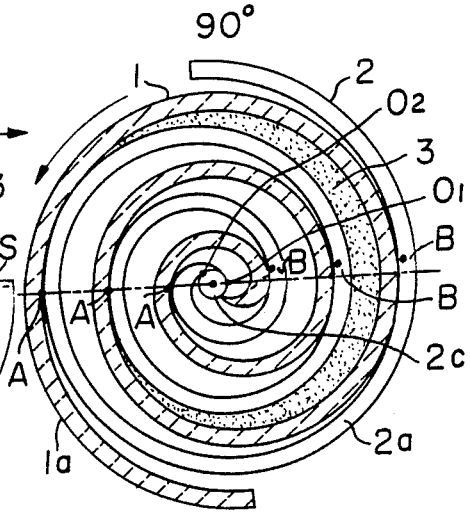
Figure 6D:
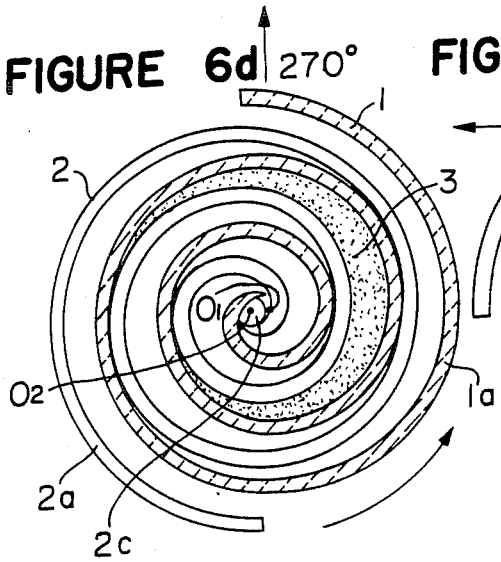
Figure 6C:
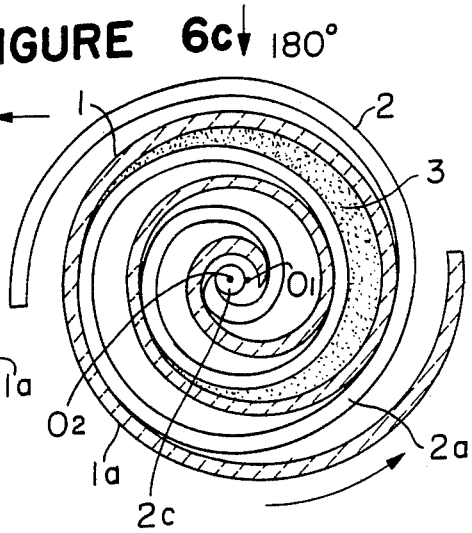

During the operation of the compression of a gas by the association of the driving and driven scrolls 1, 2, an amount of one half of a torque caused by the compression of the gas is respectively borne by the driving and driven scrolls. Since the driving scroll 1 is driven by the motor 17, the driven scroll 2 alone bears the torque of the compression with the result that the driven scroll 1 tends to rotate around the axial center $O_2$ in the opposite direction to the driving scroll 1. In this case, the driven scroll 2 comes in contact with the driving scroll 1 at the points A as shown in FIG. 6*b*, whereby the reverse rotation of the driven scroll 2 is prevented, and the operation of compression is continued.

When the driving scroll 1 is decelerated for any reason, the driven scroll 2 is caused to continue to rotate at a relatively high speed due to movement of inertia. However, the both scrolls 1, 2 are rotated in synchronism with each other while they are in contact at the points B in FIG. 6*b* even in this case.

Relation in phase of the both scrolls is certainly maintained in the case that any gaps are produced at the sealing portions s in the radial direction between the driving scroll 1 and the driven scroll 2. In fact, however, there are slight gaps $\epsilon$ between the both scrolls, whereby there results deflection in phase which correspond to an amount of the gaps. Since the wrap plates 1a, 2a are formed to have an involute curve, the following equation is given from geometrical relationship of $a\Delta\theta=\epsilon$ ($\Delta\theta$ is deflection in angle between the both scrolls):

$$\Delta\theta=\epsilon/a$$

where a is a radius of the base circle of the involute curve.

The relative movement of the driving scroll 1 and the driven scroll 2 provides the function of suction, compression and exhaustion as shown in the diagrams of FIG. 6. Compressed gas is discharged through the discharging conduit 2c. During the rotation of the driven scroll 2, the sliding area between the driven scroll shaft 5 and the rotary mechanical seal 24 and the fixed mechanical seal 25 prevents leakage of the compressed gas. The rotation of the scrolls 1, 2 sucks the gas into the container 6 through the intake tube 30, which cools the motor 17 and the bearings through the upper and lower bearing supporter 7, 11 (although indication of the passage of the gas is omitted in FIG. 1), and the gas is introduced in the compression chamber 3 formed by the scrolls 1, 2.

The rotation of the driving shaft 4 actuates the oil pump 28 to supply the lubricating oil 33 to the oil reservoir 21 through the oil feeding pipe 29; then, the oil 33 lubricates the mechanical seals 24, 25 and the bearings 15, 16, 14, 8, 9, 10 and finally, returned to the bottom of the container 6.

In this embodiment, an Oldham coupling is omitted and the driven scroll 2 is rotated by the driving scroll 1 through the direct contact between the wrap plates 1a, 2a. For this purpose, materials having different properties of hardness are used for the scrolls to reduce wearing of the contacting areas (portions A, B in FIG. 6). Selection of the materials is made so as to minimize the wearing.

As an alternate way, the areas of contact of the both wrap plates 1a, 2a are respectively covered by materials having different wearing resistance properties.

For the purpose of minimizing noise by the contact of the both scrolls 1, 2, a self-lubricating material may be firmly attached on the contacting area of either of the scrolls 1, 2. Or, at least one of the wrap plates is formed by a self-lubricating material having wearing resistance properties.

In the embodiment described above, the distance between both shafts of the scrolls is determined to have a given value so that the driven scroll is rotated by the driving scroll in a synchronous manner by the mutual contact at the sealing portions of the both wrap plates. Accordingly, provision of the Oldham coupling is not needed, the number of the structural elements is reduced to provide a simple construction, the entire size of the apparatus is reduced, the manufacturing cost is lowered and the apparatus is operated at a high speed and with high efficiency while vibrations are suppressed during the operation.

FIGS. 2 to 5 show a second embodiment which is a modified form of the first embodiment shown in FIG. 1. In the Figures, the same reference numerals designate the same were corresponding parts.

The second embodiment is to overcome such problem that when the driving and driven scrolls 1, 2 which are placed in such a manner that the wrap plates 1a, 2a are symmetric with respect to the revolution center, are rotated, substantially large vibrations and noises are caused because of unbalance of centrifugal force which is resulted from the fact that the center of gravity of each of the scrolls 1, 2 is deflected from the respective center of revolution. There is another problem that an increased amount of load acts on the each bearing member for the supporting shafts.

In FIGS. 2 to 5, a driving scroll 1 comprises a circular plate 1b, a boss 1f projecting from one surface of the circular plate 1b and two wrap plates 1e formed on the other surface of the circular plate 1b. The two wrap plates 1e the same configuration are arranged in such a manner that they are symmetric with respect to the axial center or $O_1$ of revolution and have the same pitch in the circumferential direction so as to obtain a balanced centrifugal force when it is rotated. The boss 1f is provided with a recess in which a shaft is fitted.

Figure 3:
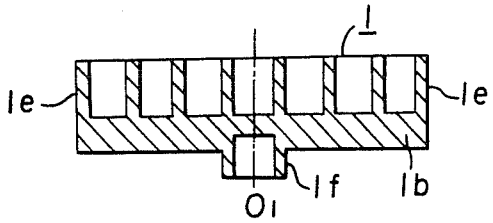
FIG. 3 is a cross-sectional view of the driving scroll shown in FIG. 2.
Figure 4:
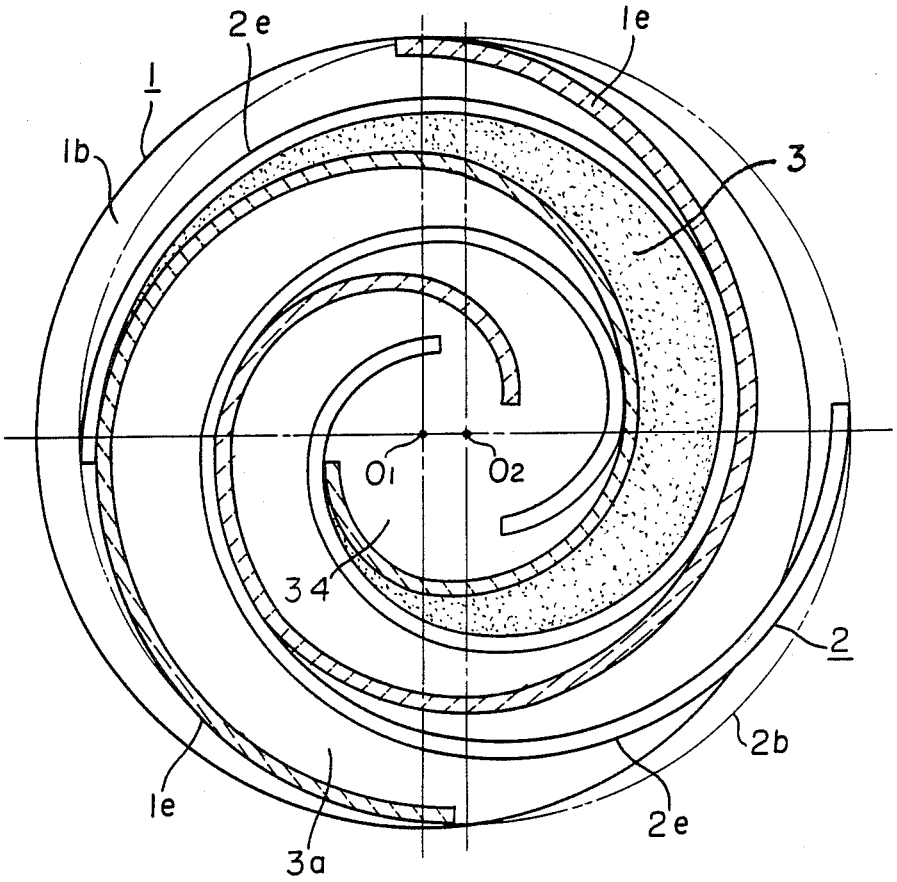
FIG. 4 is a diagram showing the combination of the driving and driven scrolls used for the present invention.

FIG. 4 is a diagram showing that a driven scroll 2 is combined with the driving scroll as in FIG. 3. For simplification, the number of turns of the wrap plates is reduced in FIG. 4. The driven scroll 2 also comprises a circular plate 2b and two wrap plates 2e which have the same shape as that of the driving scroll and are arranged at positions symmetric with respect to the axial center $O_2$ of revolution and at the same pitch in the circumferential direction so as obtain a balanced centrifugal force.

FIG. 4 shows the state that a suction step by the compression chamber 3 has finished. A reference numeral 3a designates the compression chamber before effecting the compression. FIG. 4 shows that the suction step is conducted four times during one revolution, namely, the phase of suction is shifted for each one fourth of the revolution (90°).

In case that two wrap plates are formed on the circular plate of each of the scrolls 1, 2, communication between the compression chamber 3a and the discharging chamber 34 must be avoided in the suction step at any angle of revolution. Accordingly, in the embodiment shown in FIG. 4, the number of turns of the wrap plates is at least one and one fourth. It is understandable that the value is geometrically smallest. If the number of turns is one and one fourth, the ratio of the volume of the chamber is 1. In this case, the function of compression is not theoretically provided and the device functions as a pump. Accordingly, when two wrap plates are provided in each of the scrolls, the number of turns is equal to or or greater than $1\frac{1}{4}(\geqq 1\frac{1}{4})$ Generally, an N ($N\geqq 1$) number of wrap plates are formed in each of the scrolls, the number of turns is equal to or greater than $1\frac{1}{2}N\geqq(\geqq 1\frac{1}{2}N)$.

When N number of wrap plates are respectively formed in the driving and driven scrolls 1, 2, there are 2N times of suction during one revolution and the phase of suction is shifted for each 360°/(2N). If a numerous number of wrap plates are formed on the scrolls ($N\rightarrow\infty$), the number of turns can be at least one.

The scroll compressor having each two wrap plates 1e, 2e as shown in FIG. 4 performs four times of suction during one revolution in comparison with the conventional scroll compressor shown in FIG. 6 which performs only one suction during one revolution. Accordingly, the scroll compressor of the second embodiment reduces pulsation of the compressed gas with the result that variation of a torque and vibration of the compressor are remakably decreased.

Figure 5:
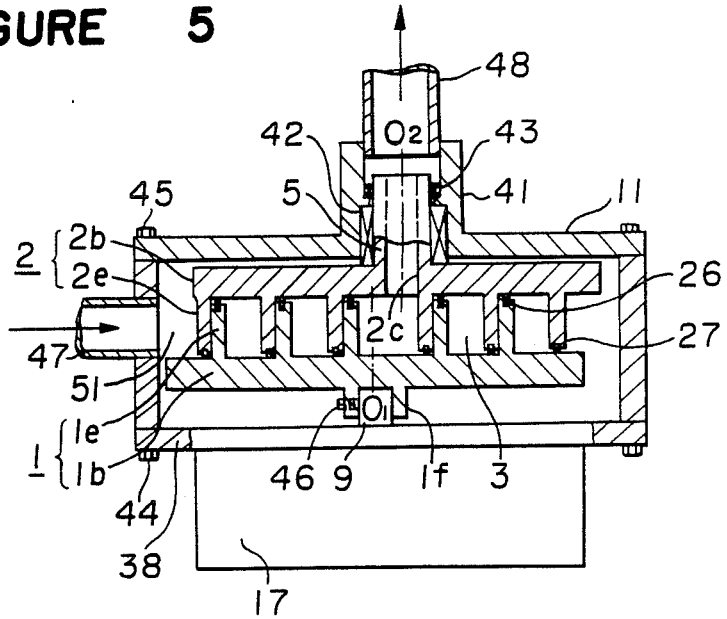
FIG. 5 is a longitudinal cross-sectional view of an important part of the scroll compressor according to an embodiment of the present invention.

FIG. 5 is a longitudinal cross-sectional view of the scroll compressor shown in FIG. 4 in which the driving and driven scrolls are combined together. The driving scroll 1 has two wrap plates 1e on the circular plate 1b.

The driven scroll 2 has two wrap plates 2e on the circular plate 2b. The hollow shaft having the outlet port 2c is firmly attached to or integrally formed with the driven scroll 2. A motor as a driving source 17 is fixed to a flange member 38 which is in turn fixed to the container 6 by means of bolts 44. The boss 1f of the driving scroll 1 is adapted to be connected with the rotary shaft 4 by means of a fixing screw 46. The upper bearing supporter 11 is fixed to the container 6 by means of fixing bolts 45 so as to oppose the motor 17 with respect to the scrolls 1, 2. A cylindrical boss 41 is attached to or integrally formed with the upper surface of the bearing supporter 11. A bearing 42 is fitted to the inner wall of the cylindrical boss to support the shaft 5 which may be of a radial-thrust type when a high compressing force is produced in the compression chamber 3. A reference numeral 43 designates a shaft sealing member for the shaft 5 fitted to the boss, a numeral 47 designates an intake tube firmly attached to the container 6 to introduce a gas, and a numeral 48 designates a discharging tube firmly attached to the upper bearing supporter 14 to discharge the compressed gas. The tip seals 26, 27 are respectively fitted in the spiral grooves formed in the top surface of the wrap plates 1e, 2e. The tip seals 26, 27 may be omitted when the pressure of gas in the compression chamber 3 is low. A numeral 51 designates a suction chamber formed by the container, the upper part of the motor 17 and the lower part of the upper bearing supporter 11.

The operation of the scroll compressor according to the second embodiment will be described.

On actuation of the motor 17, the driving scroll 1 is rotated around the axial center $O_1$ with the consequence that the driven scroll 2 is rotated around the axial center $O_2$ by the mutual contact between the wrap plates 1e, 2e. The associated revolution of the scrolls performs the function of suction, compression and exhaustion of the gas according to the principle as illustrated in FIG. 6.

The gas is sucked into the suction chamber 51 through the intake tube 47 by the revolution of the scrolls 1, 2, then is compressed in the compression chamber 3, and the compressed gas is forcibly supplied out of the compressor through the outlet port 2c and the discharge tube 48.

The shaft sealing member 43 placed between the outer circumferential surface of the shaft 5 for the driven scroll 2 and the inner circumferential surface of the cylindrical boss 41 of the upper bearing supporter 11 prevents the compressed gas at the outlet port from leaking to the suction chamber 51. The shaft sealing member 43 may be omitted when the pressure of the compressed gas to be produced in the compression chamber is low.

As described above, in accordance with the second embodiment of the present invention, a plurality of wrap plates are formed in each of the scrolls around axial center of revolution and at the same pitch in the the circumferential direction. Accordingly, the centrifugal force resulted from the revolution of the scrolls are balanced whereby a smooth rotation of the scrolls is maintained, hence a load applied to the bearings is reduced. Further, since plural times of suction of the gas are carried out during one revolution, variation in a compressing torque is reduced, the vibrations and noises are remakably minimized. The scroll compressor of the present invention is especially preferable to a super-high speed operation.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll compressor which comprises:

a sealing container, a first fixed part placed inside said container, a driving scroll comprising a circular plate portion, a wrap plate formed on a surface of said circular plate portion and a driving shaft extending from the other surface of said circular plate portion, said shaft being rotatably supported by said first fixed part, a second fixed part placed inside said container so as to oppose said first fixed part with a certain space, a driven scroll comprising a circular plate portion and a driven shaft extending from the other surface of said circular plate portion in the opposite direction to the shaft of said driving scroll, wherein the driven shaft of said driven scroll is rotatably supported by said second fixed part so that the axis of rotation of said driven scroll shaft is deviated from the axis of rotation of said driving scroll; the wrap plates of said driving and driven scrolls are mutually combined with each other so that the parts of the side surfaces of the wrap plates come in contact to form a compression chamber and said driven scroll is directly driven by said driving scroll in synchronism therewith, and wherein a discharging conduit extends through said driven shaft from said compression chamber to an end of said driven shaft opposite said circular plate portion of said driven scroll, whereby the function of compression of a fluid is obtainable during the movement of said compression chamber toward the centers of said driving and driven scrolls, a stationary discharge means communicating with said discharge conduit at said opposite end of said driven shaft, seal means between said driven shaft and said stationary discharge means for sealing the rotary joint therebetween, for lubricating said seal means, wherein said lubricating means comprise an oil reservoir within which said seal means is positioned, whereby said seal means is immersed in a bath of oil within said oil reservoir.

2. The scroll compressor according to claim 1, wherein the material of the wrap plate of said driven scroll is different from the material of the wrap plate of said driving scroll, whereby wearing of said wrap plates by mutual contact is reduced.

3. The scroll compressor according to claim 1, wherein the shaft of said driving scroll is connected to a motor, and the shaft of said driven scroll is supported by said second fixed part through at least one sealing member.

4. The scroll compressor according to claim 1, wherein each of said driving and driven scrolls has a plurality of wrap plates having the same shape which are arranged at the same pitch in the circumferential direction.

5. The scroll compressor according to claim 4, wherein each of the wrap plates of said driving and driven scrolls is arranged to have the number of turns T as expressed by $T \geqq 1\frac{1}{2}N$, where the number of the wrap plates of each of said driving and driven scrolls is N ($N \geqq 1$).

* * * * *